US005325989A

United States Patent [19]

Karalus

[11] Patent Number: 5,325,989

[45] Date of Patent: Jul. 5, 1994

[54] BOX AND BLANK FOR PACKAGING POWDERED SOAP OR THE LIKE

[75] Inventor: Kenneth D. Karalus, Bellevue, Wash.

[73] Assignee: Eagle Paper Box Company, Tacoma, Wash.

[21] Appl. No.: 56,225

[22] Filed: May 4, 1993

[51] Int. Cl.[5] ..... B65D 90/04

[52] U.S. Cl. ..... 220/416; 229/223; 229/225

[58] Field of Search ..... 220/416; 229/210, 221, 229/223, 224, 225, 134

[56] References Cited

U.S. PATENT DOCUMENTS

| | | | |
|---|---|---|---|
| 2,348,377 | 5/1944 | Goodyear | 229/225 |
| 2,367,476 | 1/1945 | Tyrseck | 229/225 |
| 2,950,043 | 8/1960 | Ringler . | |
| 2,951,627 | 9/1960 | Wenzel . | |
| 2,997,220 | 8/1961 | Williamson . | |
| 3,013,712 | 12/1961 | Wollaeger | 229/210 X |
| 3,137,437 | 6/1964 | Svensson | 229/210 X |
| 3,253,764 | 5/1966 | Goetschius et al. | 220/465 |
| 3,708,108 | 1/1973 | Rosenburg . | |
| 4,428,500 | 1/1984 | Kohler | 220/462 |
| 4,726,471 | 2/1988 | Whately . | |
| 4,915,292 | 4/1990 | Ielmini | 229/132 |
| 4,986,420 | 1/1991 | Gunn et al. | 220/462 X |
| 4,989,780 | 2/1991 | Foote et al. | 229/132 X |
| 5,036,982 | 8/1991 | Aston . | |
| 5,058,748 | 10/1991 | Giblin . | |
| 5,090,616 | 2/1992 | Bertsch | 229/134 X |
| 5,161,733 | 11/1992 | Latif | 229/225 |
| 5,219,089 | 6/1993 | Kiolbasa et al. | 220/441 X |

*Primary Examiner*—Allan N. Shoap
*Assistant Examiner*—Christopher J. McDonald
*Attorney, Agent, or Firm*—Schlesinger Arkwright & Garvey

[57] ABSTRACT

A blank and method of folding for forming a box for granular material such as soap and the like including one piece of stock material having a first series of panels for forming outer walls of the box and a second series of connected panels for forming a liner within the box. The box includes top and bottom end flaps on each of the outer panels of substantial length for substantial overlapping of the end flaps to create a secure seal at both the top and the bottom ends of the box. The box also includes a tear strip opening and a resealable cap structure which is formed after the tear strip is removed.

18 Claims, 3 Drawing Sheets

BOX AND BLANK FOR PACKAGING POWDERED SOAP OR THE LIKE

FIELD OF THE INVENTION

This invention pertains to a blank and box for packaging granular or powdered materials such as laundry detergent and the like. Specifically, a resealable package of sturdy construction for shipping and displaying for sale powdered or granular material.

BACKGROUND OF THE INVENTION

Packages having inner liners have been previously constructed primarily for use with tea bags as shown by U.S. Pat. No. 5,036,982 to Aston and U.S. Pat. No. 4,726,471 of Whately. While these prior packaging containers utilize a liner construction for its resealable characteristics, they failed to appreciate the need to create a sturdy rectilinear box construction for use with heavy powdered or granular materials.

Prior to the present invention, the packaging industry has been unable to develop a box of sturdy design which is versatile for any size box with security and sturdiness to prevent loss of product during shipping and leakage of product on the shelf.

OBJECTS AND SUMMARY OF THE INVENTION

Accordingly, it is an object of the present invention to provide an improved blank and package for powdered or granulated products such as soap or the like on the shelf.

Another object of the invention is to provide a carton blank that can be readily erected by mechanical means.

Another object of the invention is to provide a lined box that can be erected from one piece of material.

In another object of the invention is to provide a box for powdered or granular material with a superior seal.

A further object of the invention is to provide a box that can be readily resealed after the initial opening.

Yet another object of the invention is to provide a box having ends having a substantially continuous surface for facilitating printing thereon.

Yet another object of the invention is to provide a box blank with horizontally staggered hinge lines formed intermediate the box body panels for accommodating layering of the end panels.

Still another object of the invention is to provide a box having embossed and/or debossed end panel flaps to provide a secure seal of the ends of the box.

Yet another object of the invention is to provide a box which can be constructed with a zipper type carton opening strip.

Another object of the invention is to provide a box having a string opening structure.

Still another object of the invention is to provide a box having an offset score line opening structure.

In summary, this invention discloses a novel design for a box blank of one piece construction including a liner and four end flaps on each end for securely closing the box ends to prevent loss of product as well as to provide an economical manufacturing and assembling structure.

DETAILED DESCRIPTION OF THE INVENTION

Figure 1:
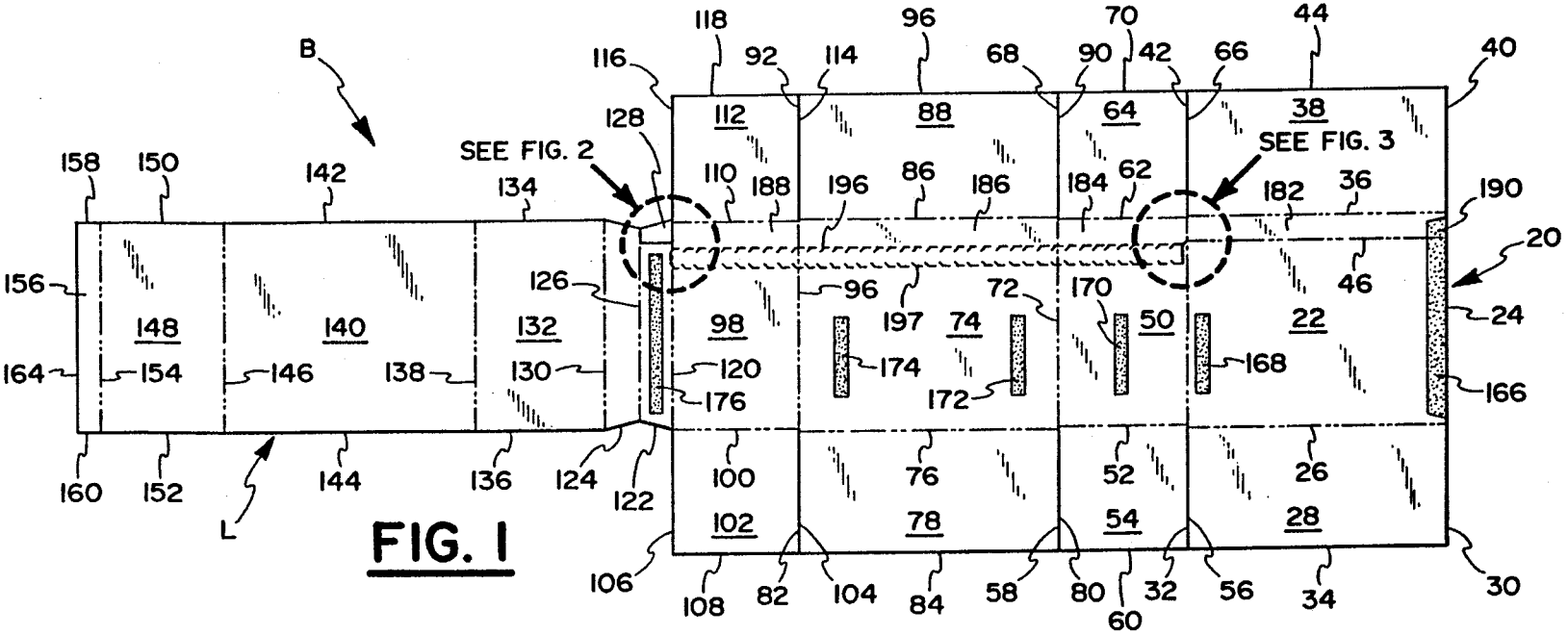
FIG. 1 is a plan view of the inner surface of a flat blank formed in accordance with the present invention.

FIG. 1 shows a box blank B having an outer box forming portion 20 having a first panel 22 having an end edge 24, a bottom fold line 26 connecting first panel 22 to bottom closure flap 28. Closure flap 28 includes a pair of oppositely positioned side edges 30 and 32 wherein side edge 30 is generally a linear continuation of side edge 24. Bottom flap 28 further includes end edge 34 which extends generally the entire width of first panel 22. Fold line 36 defines the upper end of first panel 22 and the bottom edge of upper end flap 38. Upper end flap 38 includes side edges 40 and 42. Side edge 40 is substantially collinear with side edge 24. Upper end flap 38 further includes end edge 44 which is generally coextensive and spaced from first panel 22. First panel 22 further includes an intermediate fold line 46 which extends substantially parallel and spaced downwardly from fold line 36. Fold line 48 defines a second side edge of first panel 22 and separates first panel 22 from second panel 50.

Second panel 50 includes a bottom fold line 52 which connects second panel 50 with second panel bottom end flap 54. Second panel end flap 54 includes a first side edge 56 spaced from and parallel to a second side edge 58 and end edge 60 which substantially extends generally the width of panel 50. Second panel 50 further includes a top fold line 62 defining the top edge of second panel 50 and bottom edge of second panel upper end flap 64. Second panel upper end flap 64 includes a first side edge 66 spaced from and substantially parallel to a second side edge 68 both side edges 66 and 68 being substantially perpendicular to a top edge 70 which extends substantially the width of second panel 50. The width of second panel 50 is defined by the space between fold line 48 and fold line 72 which is substantially parallel to fold line 48. Fold line 72 connects second panel 50 with third panel 74.

Third panel 74 includes a bottom fold line 76 which connects third panel 74 to bottom panel end flap 78. Bottom panel end flap 78 includes first side edge 80 and a second side edge 82 which are spaced apart and substantially parallel to each other. Bottom panel end flap 78 includes a bottom edge 84 which is substantially the same length as fold line 76. Third panel 74 includes an upper fold line 86 which joins third panel 74 to third panel upper end flap 88. Third panel upper end flap 88 includes a first side edge 90 and a second oppositely positioned and substantially parallel side edge 92. Upper third panel end flap 88 further includes edge 94 which extends substantially parallel to fold line 86. Third panel 74 includes a fold line 96 which is spaced opposite and parallel to fold line 72 and joins third panel 74 with fourth panel 98.

Fourth panel 98 is joined by fold line 100 to fourth panel bottom end flap 102. Bottom panel end flap 102 includes first and second side edges 104 and 106 respectively which are spaced apart and substantially parallel. Bottom panel end flap 102 further includes a bottom edge 108 which extends substantially parallel to and spaced from fold line 100. Fourth panel 98 includes an upper fold line 110 which joins fourth panel 98 to fourth panel upper end flap 112. Upper end flap 112 includes side edges 114 and 116 which are oppositely spaced substantially parallel and substantially the same length and end edge 118 which extends substantially parallel to and spaced from fold line 110. The width of panel 98 is defined by the space between fold line 96 and fold line 120.

As can be seen in FIG. 1, panels 22 and 74 are larger in height than panels 50 and 98 by a distance equal to about two times the thickness of the paper stock to allow for reduced stress on the material when it is folded and to permit a 90° bend at the fold lines.

Fold line 120 joins the outer box forming portion 20 of the box blank B as previously described, to the liner L. Liner L includes a pair of first and second thin panels 122 and 124 which are connected to the outer box panel 98 by fold line 120. First and second liner panels 122 and 124 are formed of a complimentary shape to allow the panels 122 and 124 to he folded over one another. First and second liner panels 122 and 124 are joined by a fold line 126 which is both perforated and scored to facilitate a 180° fold so that when a box is formed from blank B, panel 124 can he folded to lie flat against panel 122. Panel 122 further includes an ear tab 128 which will he described in greater detail with respect to FIG. 2.

Fold line 130 joins second liner panel 124 to third liner panel 132. Fold line 130 is also perforated and scored to facilitate a square corner during the folding process. Third liner panel 132 includes an upper end edge 134 and a lower end edge 136. End edges 134 and 136 are substantially parallel and preferably of a length such that panel 132 is slimmer than panel 98 by a degree of two to three thicknesses of the paper used to construct the box. Third liner panel 132 is connected by a fold line 138 to fourth liner panel 140.

Fourth liner panel includes an upper end edge 142 and a lower end edge 144. Edges 142 and 144 are preferably slightly shorter by the width of two times the thickness of the paper used than the with of panel 74. Fourth liner panel 140 is joined by fold line 146 to fifth liner panel 148. Fifth liner panel 148 includes an upper edge 150 and a lower edge 152. Edges 150 and 152 are preferably of a length which is slightly shorter than the width of second panel 50. Fifth liner panel 148 is joined by fold line 154 to sixth liner panel 156. Sixth liner panel 156 includes upper and lower end edges 158 and 160, respectively, which are substantially parallel to each other and of substantially the same length preferably. Sixth liner panel 156 also includes an end edge 162 which is oppositely spaced from fold line 154 and of substantially the same length. While sixth liner panel 156 may be of any shape, it preferably forms a strip of sufficient width to create a gluing surface.

Preferably, the interior walls of panels 22, 50, 74 and 122 include glue strips 166, 168, 170, 172, 174 and 176 to adhere the liner L to the interior of the box B.

A zipper type tear strip opening structure 180 extends across the upper portions of panels 50, 74 and 98. When the zipper 180 is removed (as will be discussed with respect to FIGS. 10 and 11) a reclosable cap C (see FIG. 11) is formed out of upper end flaps 38, 64, 88 and 112 and the upper portions 182, 184, 186 and 188 of panels 22, 50, 74, 98, respectively and ear tab 128. Ear tab 128 is designed to connect to the upper portion 190 of glue strip 166 which extends upwardly into upper portion 182 of first panel 22 and prevent tearing of upper portion 182. Upper portion 182 is defined by the area between fold lines 36 and 46 of first panel 22. Each of upper portions 184, 186 and 188 are defined by that area of panels 50, 74 and 98, respectively which extends between their upper fold lines 62, 86 and 110, respectively and tear strip 180.

Figure 3:
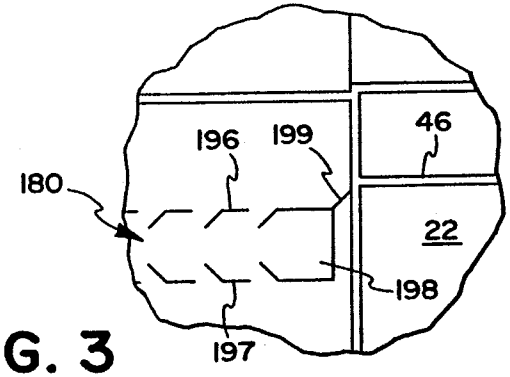
FIG. 3 is an enlarged view of the end portion of the tear tab structure of FIG. 1.
Figure 2:
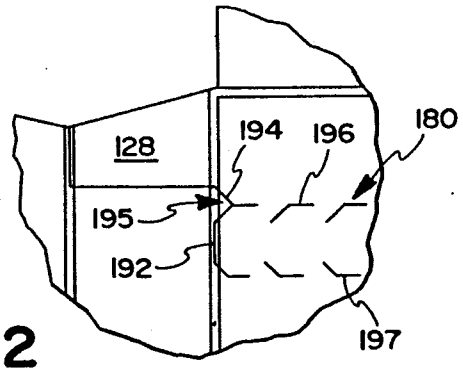
FIG. 2 is an enlarged view of the tear tab structure of FIG. 1.

FIGS. 2 and 3 show enlarged views of the circled portions of FIG. 1 to permit a detailed view of important features of the tear strip 180. As shown in FIG. 2, tear strip 180 includes a starting tab 192 wherein tearing of the tear strip begins when it is grasped by the thumb and forefinger and pulled outwardly from the box. A knife cut 194 to facilitate grasping of tab 192 prevents tearing of upper portion 188 by creating an angled slot 195 adjoining the upper lines of weakness 196 of tear strip 180. Knife cut 194 extends across panel 122 and upwardly along fold line 126 to separate tab 128 from panel 122. Upper line of weakness 196 extends across panels 98, 74 and 50 as shown in FIG. 1 and a lower line of weakness 197 extends across panels 98, 74 and 50 to define tear strip 180.

FIG. 3 shows the end of the tear strip 198 opposite the tab 192 and includes a knife cut 199 extending therefrom to permit opening of the box lid. Knife cut 199 extends from end 198 up to a point near fold line 46 of first panel 22. The knife cut 199 is an important feature of the invention in that it prevents accidental tearing of first panel 22 which is substantially unlined. Since the liner L does not cover a majority of first panel 22, any tearing of panel 22 can cause weakness particularly along fold line 46 which after repeated usage could cause cap C (see FIG. 11) to be accidentally torn from the box if tearing occurred into panel 22.

THE FOLDING SEQUENCE

FIGS. 4–9

Figure 4:
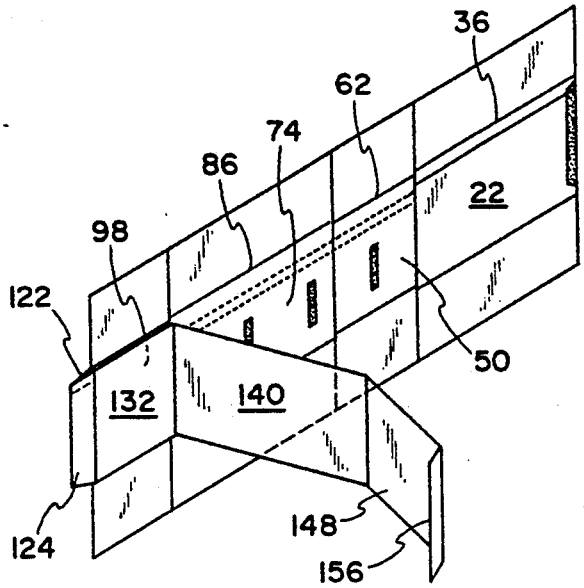
FIG. 4 shows the blank of FIG. 1 with the inner liner partially folded.

FIG. 4 shows the initial folding sequence of folding the liner L formed of the box panels 98, 74, 50 and 22. As shown in FIG. 4, panel 124 has been folded over panel 122 and panel 132 is folded to lie against panel 98 while panels 140, 148 and 156 have yet to be folded against panels 74, 50 and 22.

Figure 5:
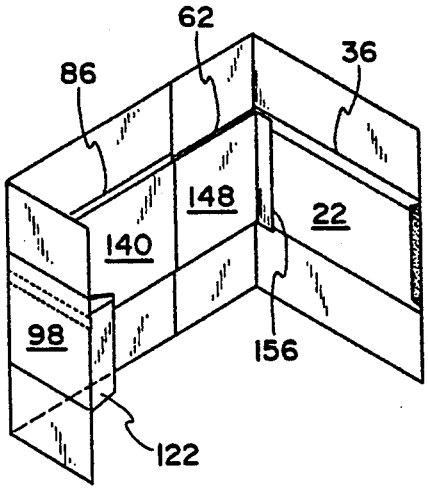
FIG. 5 is a perspective view of the blank of FIGS. 1 and 4 having the inner liner completely folded so as to overlap the inside surfaces of the outer wall panels.

FIG. 5 shows the folding sequence after panels 140, 148 and 156 have been folded against panels 74, 50 and 22, respectively.

Figure 6:
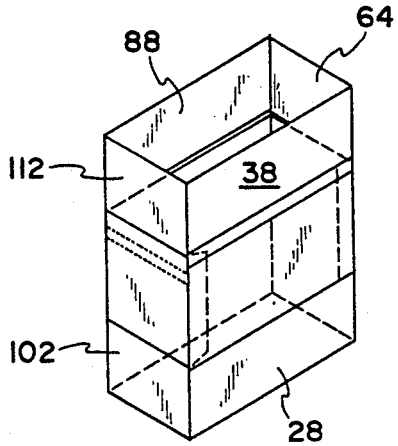
FIG. 6 shows the blank of FIGS. 4 and 5 folded to form a tube.

FIG. 6 shows the box blank with first outer box panel 22 joined with liner panel 122 with the corners squared to form a rectangular tubular structure.

Figure 7:
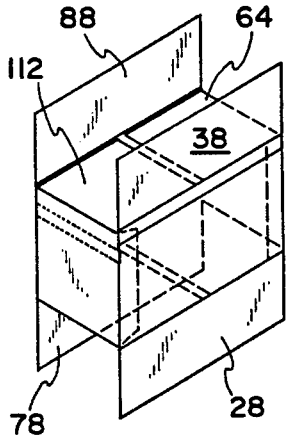
FIG. 7 is a perspective view of the tube of FIG. 6 having the small end flaps folded inwardly.

FIG. 7 shows the box of FIG. 6 with the top end flaps 112 and 64 folded inwardly and also having bottom flaps 102 and 54 folded inwardly.

Figure 8:
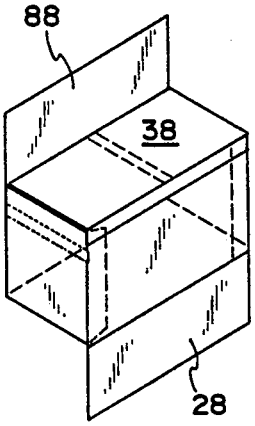
FIG. 8 shows the folded blank of FIG. 7 further having one of the large end panels at each of the top and bottom ends folded inwardly.

FIG. 8 shows end flaps 38 and 78 folded inwardly to overlie their respective end flap and are preferably adhered thereto through use of suitable adhesive.

Figure 9:
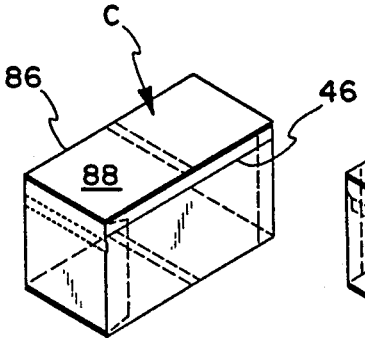
FIG. 9 shows the box of FIG. 8 having all end panels folded forming a rectilinear box.

FIG. 9 shows the completed box having top and bottom flaps 88 and 28 respectively wherein upper flap 88 overlies flap 38 and bottom flap 28 overlies bottom flap 78, each of the flaps being adhesively joined to the other.

BOX OPENING SEQUENCE

FIGS. 10 AND 11

Figure 10:
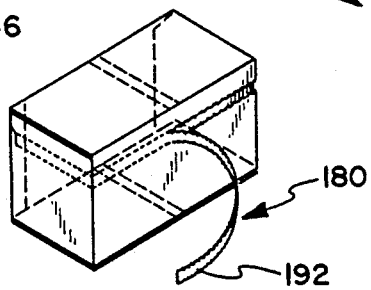
FIG. 10 shows the rectilinear box of FIG. 9 rotated 180°.

FIG. 10 shows the box of FIG. 9 rotated to show the tear strip 180 partially torn so that access to the interior of the box may be obtained.

Figure 11:
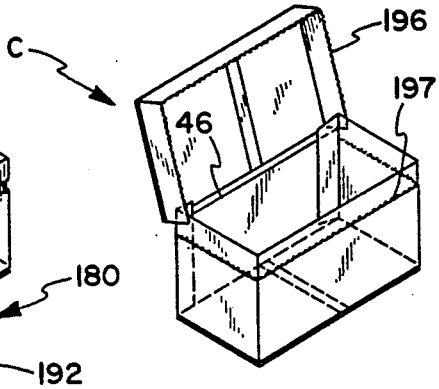
FIG. 11 shows the box of FIG. 10 having the tear strip removed and the lid opened.

FIG. 11 shows the tear strip entirely removed and the upper portion of the box or cap C opened showing the rough edges of the lines of weakness 196 and 197 after the tear strip 180 has been removed. FIG. 11 also shows the upper portions of panels 132, 140, 148 and 156 extending above the outer box panels 22, 50, 74 and 98 which along with the upper edges 134, 142 and 150 of panels 132, 140 and 148 respectively provide a frictional surface against which the upper portions 184, 186 and 188 of panels 50, 74 and 98, respectively, engage to reseal box B.

ALTERNATIVE EMBODIMENTS

FIGS. 12–15

Figure 12:
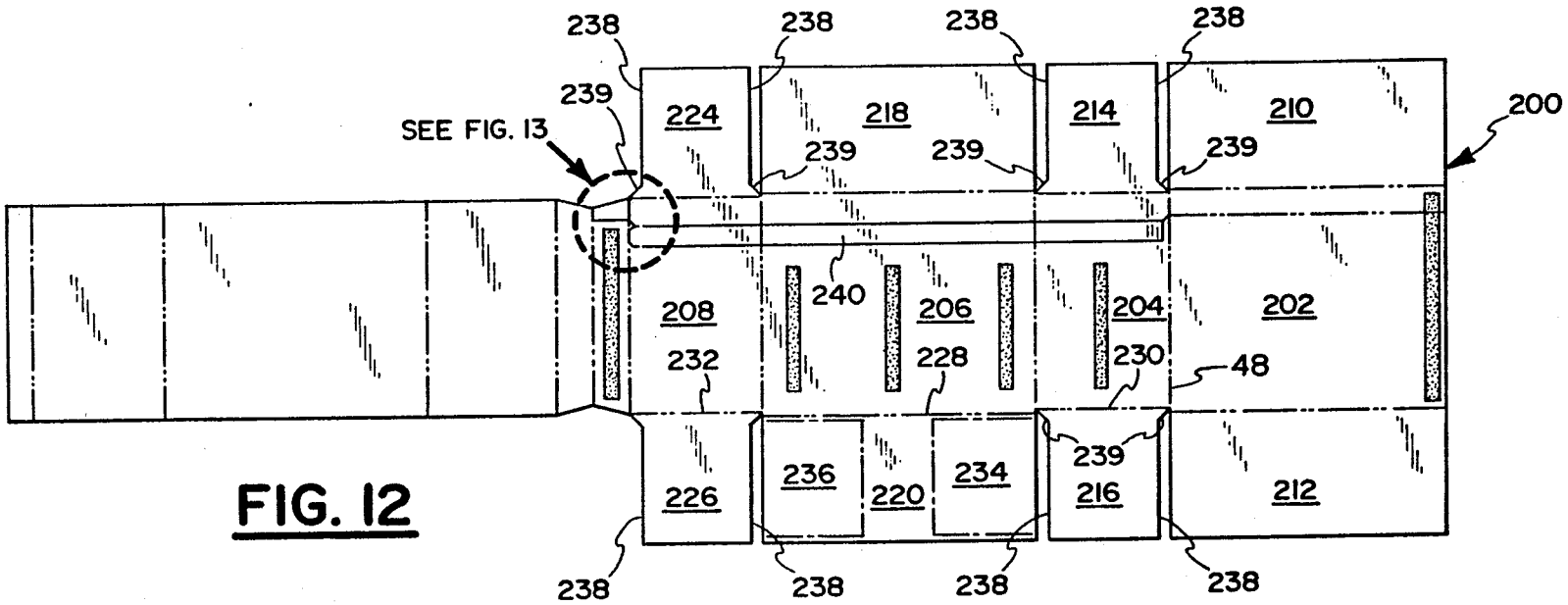
FIG. 12 shows another embodiment of a blank for the rectilinear box.

FIG. 12 shows an alternative box design 200 having a series of outer box panels 202, 204, 206 and 208. Each of these panels have upper and lower end flaps 210, 212 and 214, 216 and 218, 220 and 224, 226, respectively. In the alternative embodiment of box 200, the larger top and bottom flaps may have embosses or debosses which assist in joining the end flaps together to form a top and a bottom of box 200. For example, flap 220 which is hinged to panel 206 by fold line 228 would preferably be folded in exteriorly of flaps 216 and 226 after flap 216 has been folded inwardly 90° along fold line 230 and flap 226 has been folded inwardly 90° along fold line 232. Flap 220 would include the pressed areas 234 and 236 which would seat against flaps 216 and 226. The debosses 234 and 236 shown on flap 220 are by way of example only and if the folding order of the flaps were changed, the debosses or embosses could be placed on any large flaps 210, 212, 218 or 220 so that any of those flaps could have recessed areas on either its inner or outer surface to enhance connection of the flap end structures. The smaller end flaps 214, 216, 224 and 226 may include gullets 238 which enhance folding of end flaps 214, 216, 224 and 226 but still prevent leakage of product through the use of angled inner feet 239.

FIG. 12 also includes a tear strip 240. The tab portion of tear strip 240 is enlarged and shown in FIG. 13.

Figure 13:
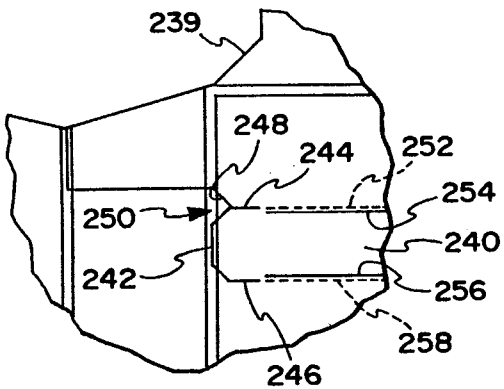
FIG. 13 is an enlarged view showing the tear strip tab structure of the blank of FIG. 12.

Now referring to FIG. 13, tear strip 240 includes a tear tab 242 for grasping between the thumb and forefinger. Tear tab 242 is formed by horizontal knife cuts 244 and 246. Knife cut 248 creates an upper open edge 250 which permits easier grasping of tear tab 242 and prevents tearing of upper portion of panel 208. Tear strip 240 is formed by two upper cuts 252 and 254 and two lower cuts 256 and 258, with 254 and 256 being the inner cuts and 258 and 252 being the two outer cuts. Each of the cuts is formed by cutting about three fourth's through the thickness of the paper used in creating the box 200 whereas cuts 252 and 254 are on opposite sides of the paper stock and are slightly vertically offset as are cut lines 256 and 258 to create a thin weakness line which will tear before the main body of the stock material when tear tab 242 is pulled outwardly from the surface of the stock material.

Figure 14:
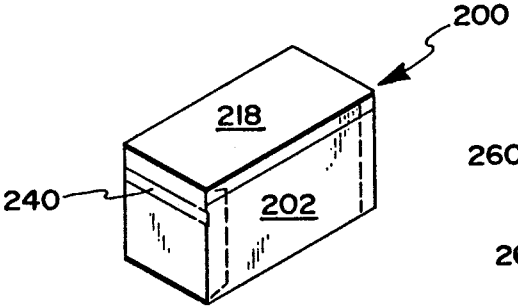
FIG. 14 is a perspective view of the rectilinear box design of FIGS. 12 and 13; and, FIG. 15 is yet another example of box design showing a tear string structure for separate two sides and the front panel of the box so that a lid can be folded backward and the box opened for access to the interior thereof.

FIG. 14 shows the completed box construction formed by folding the blank of FIG. 12 showing the tear strip 240.

Figure 15:
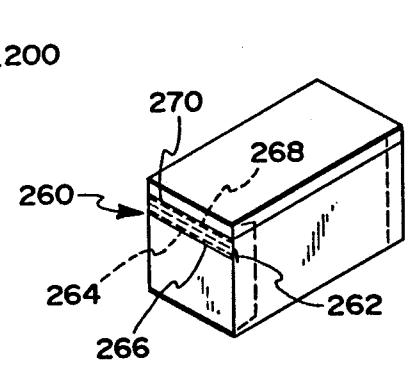

FIG. 15 shows an example of alternate embodiment using a tear string which would be adhered to the interior of a blank such as that shown in FIG. 12 which would exclude tear strip 240 and substitute tear string 260 therefor. The box shown in FIG. 15 can be opened by grasping the free end 262 of tear string 260 and pulling outwardly so that the box may be opened in the same manner as the box in FIG. 11. Tear string 260 is located in an embossed channel 264 having upper and lower pairs of cuts 266, 268, 220 and 272 as described with respect to FIG. 13 to facilitate tearing.

Preferably, the outer surfaces of the box B of FIG. 10 as well as the boxes of FIGS. 14 and 15 would be coated with a clay material suitable for printing. The interior surfaces of panel 132, 140, 148 and 156 are preferably coated with a polyethylene liner material which will prevent moisture from passing through the stock material.

It should be understood that the box may be constructed of heavy weight paper, cardboard or plastic material suitable for the intended use of holding granular or powered material such as soap. Furthermore, the end flaps of the box panels may be adhered together through the use of hot melt adhesive or any other suitable connecting substance or device.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A box for forming a package for granular material, said box comprising:

a) a first series of connected panels for forming outer walls of the box;

b) a second series of panels forming a liner within said box;

c) said first series of panels including connected first, second, third and fourth panels;

d) said second series of panels including first, second and third panels;

e) each of said panels of said first series including a pair of oppositely positioned closure flaps for forming the top and bottom ends of the box;

f) a tear strip disposed on at least three of said outer walls of said box, said tear strip being located between said top and bottom ends of said box, said tear strip defining a cap above said tear portion and defining a main body below said tear portion;

g) a first angled knife cut initiating said tear strip, said first angled knife cut being disposed on one of said at least three outer walls;

h) a second angled knife cut terminating said tear strip, said second angled knife cut being disposed on another one of said at least three outer walls distant from said first angled knife cut;

i) each said first and second angled knife cuts preventing tearing into a fourth one of said outer walls; and j) wherein removal of said tear strip causes said cap to substantially separate from said main body while said first and second angled knife cuts prevent further tearing into said fourth one of said outer walls of the box during repeated opening and closing of said box by moving said cap toward and away said main body for accessing the granular material.

2. The box as set forth in claim 1, further comprising:

a) said tear strip formed in said second, third and fourth panels.

3. The box as set forth in claim 1, wherein:

a) said tear strip is formed by a pair of offset lines of weakness.

4. The box as set forth in claim 3, wherein:

a) said lines of weakness are formed by two offset pairs of cuts.

5. The box as set forth in claim 1, wherein:

a) some of said closure flaps extend substantially entirely across the width of said box.

6. The box as set forth in claim 5, wherein:

a) all of said closure flaps are nearly the same height.

7. The box of claim 1, wherein:

a) some of said closure flaps include embossed portions thereon.

8. The box of claim 1, wherein:

a) some of said closure flaps include debossed portions thereon.

9. A blank for forming a box for packaging granular material, said box comprising:

a) a first series of connected panels for forming outer walls of the box;

b) a second series of panels for forming a liner within a box;

c) said first series of panels including connected first, second, third and fourth panels;

d) said second series of panels including first, second and third panels;

e) each of said panels of said first series including a pair of oppositely positioned closure flaps for forming the top and bottom ends of the box;

f) a tear strip disposed on at least three of said first series of panels, said tear strip being locatable between top and bottom ends of a box, said tear strip defining a cap above said tear portion and defining a main body below said tear portion;

g) a first angled knife cut initiating said tear strip, said first angled knife cut being disposed on one of said first series of panels;

h) a second angled knife cut terminating said tear strip, said second angled knife cut being disposed on another one of said at least three panels of said first series of panels and distant from said first angled knife cut;

i) each said first and second angled knife cuts preventing tearing into a fourth one of said first series of panels; and j) wherein removal of said tear strip causes the cap to substantially separate from said main body while said first and second angled knife cuts prevent further tearing into the fourth one of the outer walls of a box during repeated opening and closing of a box by moving the cap toward and away from the main body for accessing the granular material.

10. The blank for forming a box for packaging as set forth in claim 9, wherein:

a) some of said flaps connected to panels of said first series include tapered gullets formed therein; and b) said tapered gullets include angled portions for maintaining a closed seal when the blank is formed into a box.

11. The blank for forming a box for packaging as set forth in claim 10, wherein:

a) some of said flaps are free of tapered gullets.

12. The blank as set forth in claim 9, wherein:

a) a fold line is defined between each one of adjacent first second, third, and fourth panels; and b) only a single one of said tapered gullets is located adjacent one of said fold lines.

13. The blank as set forth in claim 9, wherein:

a) said first panel is larger in width and height than said second panel.

14. The blank as set forth in claim 9, wherein:

a) said tear strip is formed in said second, third and fourth panels.

15. The blank as set forth in claim 9, further comprising:

a) a pair of intermediate panels connecting said first series of panels to said second series of panels.

16. The blank as set forth in claim 15, wherein:

a) said intermediate panels are connected by a fold line which is both perforated and scored for facilitating folding of said panels together.

17. The blank as set forth in claim 16, wherein:

a) said intermediate panels include one panel having a glue strip thereon for adhering to the other intermediate panel.

18. The blank as set forth in claim 9, wherein:

a) said second and third panels of said first series of panels include adhesive strips thereon for connection to said second and third panels of said second series of panels.

* * * * *